United States Patent [19]

Whatley

[11] Patent Number: 5,060,401

[45] Date of Patent: Oct. 29, 1991

[54] FOOTWEAR CUSHINONING SPRING

[76] Inventor: Ian H. Whatley, 926 Cleveland St., Apt. F-101, Greenville, S.C. 29601

[21] Appl. No.: 478,369

[22] Filed: Feb. 12, 1990

[51] Int. Cl.[5] ..... A43B 13/00

[52] U.S. Cl. ..... 36/25 R; 36/27; 36/71; 36/114; 36/7.8

[58] Field of Search ..... 36/27, 28, 29, 35 R, 36/35 B, 71, 114, 7.8

[56] References Cited

U.S. PATENT DOCUMENTS

| | | | |
|---|---|---|---|
| 224,937 | 2/1880 | Mintzier | 36/7.8 |
| 2,953,861 | 9/1960 | Horten | 36/7.8 |
| 4,492,046 | 1/1985 | Kosova | 36/27 |
| 4,546,555 | 10/1985 | Spademan | 36/28 |
| 4,566,206 | 1/1986 | Weber | 36/27 X |
| 4,592,153 | 6/1986 | Jacinto | 36/27 X |
| 4,771,554 | 9/1988 | Hannemann | 36/27 |
| 4,881,329 | 11/1989 | Crowley | 36/27 X |
| 4,910,884 | 3/1990 | Lindh et al. | 36/27 X |
| 4,924,605 | 5/1990 | Spademan | 36/114 |

FOREIGN PATENT DOCUMENTS

| | | | |
|---|---|---|---|
| 0103041 | 3/1984 | European Pat. Off. | 36/27 |
| 3415705 | 10/1985 | Fed. Rep. of Germany | 36/28 |
| 2507066 | 12/1982 | France | 36/27 |

*Primary Examiner*—Paul T. Sewell
*Assistant Examiner*—BethAnne Cicconi
*Attorney, Agent, or Firm*—Fish & Richardson

[57] ABSTRACT

An article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The term "midsole" is meant to include any cushioning or other device placed within the footwear upon which a foot is positioned during use of the article. The midsole is also provided with an external cushioning spring. This spring includes an angled strip of resilient elastic material. One end of the strip is fixed on the surface of the midsole or outsole at a location at least 3 mm below the upper surface of the midsole. The other end of the strip is fixed on the surface of the midsole at least 3 mm vertically above the location at which the one end is fixed. The external cushioning spring is fixed in a manner such that a vertical force on the footwear created by a wearer of the footwear striking the outsole on a solid surface causes the angled strip to bend between its ends thereby absorbing a portion of the force.

22 Claims, 3 Drawing Sheets

FOOTWEAR CUSHINONING SPRING

BACKGROUND OF THE INVENTION

This invention relates to cushioning devices for footwear.

Stubblefield, U.S. Pat. No. 4,372,058, describes a shoe sole having a tread which defines a longitudinally and/or laterally oriented concavity. The lower extremities of the sole are formed by downwardly and outwardly disposed flexible lugs which cushion the foot of a wearer against impact loads. Stubblefield, U.S. Pat. No. 4,449,307, describes a basketball shoe sole having a central longitudinally arranged support wall.

Parracho et al., U.S. Pat. No. 4,402,146 disclose a sole having side tabs extending from the outsole to the shoe upper. These tabs are designed to stabilize the midsole and reduce ankle fatigue.

Stirtz et al., U S. Pat. No. 4,297,796, describe an inner sole member formed of an open mesh web. The web includes elongated interwoven stretch resistant strands disposed at oblique angles relative to the longitudinal axis of the shoe. The strands act as force transmitters with respect to the sole member.

Bowerman et al., U.S. Pat. No. 4,128,950, describe a multilayered athletic shoe sole formed of synthetic plastic foam positioned between a hard outsole and an upper. A lateral extending heel stabilizer plate of solid plastic material is added to improve lateral stability.

SUMMARY OF THE INVENTION

The invention features an article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The term "midsole" is meant to include any cushioning or other device placed within the footwear upon which a foot is positioned during use of the article. The midsole is also provided with an external cushioning spring. This spring includes an angled strip of resilient elastic material. One end of the strip is fixed on the surface of the midsole or outsole at a location at least 3 mm below the upper surface of the midsole. The other end of the strip is fixed on the surface of the midsole at least 3 mm vertically above the location at which the one end is fixed. The external cushioning spring is fixed in a manner such that a vertical force on the footwear created by a wearer of the footwear striking the outsole on a solid surface causes the angled strip to bend between its ends, thereby absorbing a portion of the force.

The term "angled" is used in a broad sense in this application to encompass any shape of material having a bended portion which acts to absorb a portion of a vertical force applied to two ends of that bended portion. Thus, it includes use of an angled strip, as shown in the drawings, having a less resilient material filling in any gap between the two ends of the bended portion to give the appearance of an unbent strip of material. Such an angled strip is functionally equivalent to those shown in the drawings.

The phrase "vertically above" includes not only a structure in which the ends of the strip are fixed directly above one another, but also a structure in which one end is vertically displaced, but not directly above the other end.

In preferred embodiments, one end of the spring is fixed to the footwear at a junction between the outsole and the midsole, or at a junction between the midsole and the upper; and the spring includes an extension formed generally perpendicular to the angled strip and adapted for insertion between the outsole and midsole or the midsole and upper, most preferably the extension is fixedly connected to the angled strip.

In other preferred embodiments, the angled strip is in the form of a U, V, Z, or hairpin shape, and is fixed to the footwear at a heel portion; the external cushioning spring includes a heel cup attached to the angled strip, and is fixed to the footwear by adhesive; both of the ends of the angled strip are attached to the midsole; the footwear includes a plurality of external cushioning springs; the angled strip is applied along its length to the surface of the midsole; the angled strip is attached in the ball region of the footwear; and the angled strip is formed of plastic, rubber, or metal or carbon fiber.

In a related aspect, the invention features a method for making an article of footwear. The method includes the steps of providing an upper, an outsole, and a midsole. The midsole has an upper surface upon which a sole of a foot is positioned during use of the article. The method includes providing an external cushioning spring including an angled strip of resilient elastic material. The method features fixing the midsole between the upper and the outsole; fixing one end of the angled strip on the surface of the midsole or outsole at a location at least 3 millimeters below the upper surface of the midsole; and fixing the other end of the angled strip on the surface of the footwear at least 3 millimeters vertically above the location at which the one end is fixed.

In preferred embodiments, the method includes providing a spring having an extension formed generally perpendicular to the angled strip, and adapted for insertion between the outsole and midsole, or between the midsole and the upper; and at least one of the fixing steps includes fixing one end of the angled strip to the article of footwear by adhesive. Generally, the spring is formed as a planar piece of material or formed to follow the contours of the footwear.

This invention provides an article of footwear, generally a shoe, which is designed to absorb some of the forces caused by the wearer of the footwear landing or moving quickly during walking, running, or other sports activities. Generally the footwear is provided with one or more curved, angled or zigzagged pieces (collectively termed "angled" in this application) of resilient elastic material connected to the footwear at two points. The lower point is 3 millimeters or more below the plane of the sole of the foot in the footwear, and the upper point is at least 3 millimeters above this point, and preferably at the level of the plane of the sole of the foot. When a vertical or near vertical force is applied to the footwear the two points at which the resilient material is connected are pushed closer together. This causes the angled portion of the material to be bent and absorb a portion of the energy. As the foot lifts away from the ground, the element will return to its original shape and thus returns some of the stored energy to the wearer. Optimum results are observed when the spring portion is placed at the heel and/or under the metatarsal heads. Such locations provide most efficient protection from foot-ground reaction forces, and for energy return. In addition, by placing the spring on the surface of the sole, midsole, and upper it provides a stablizing effect on the gait of the wearer. Thus, it helps to prevent the foot from rolling to the outside or inside edge of the footwear. In this way the spring is an aid to persons suffering from pronation.

The spring is particularly advantageous when used on athletic footwear for persons running at high speeds, e.g., during races, and for persons who constantly jump up and down, e.g., in basketball. Because of the shock-absorbing effect of the springs the vertical impact forces associated with such sports are reduced, and thus chronic and acute injuries to the lower limbs prevented or reduced. When used to prevent pronation of the user, it is desirable to place springs only one on side of the footwear, rather than on both sides. Alternatively, springs having differing resilience may be placed on either side to provide protection against vertical forces applied to the foot, and also prevent pronation of the wearer.

Other features and advantages of the invention will be apparent from the following description of the preferred embodiments thereof, and from the claims.

DESCRIPTION OF THE PREFERRED EMBODIMENTS

The drawings will first briefly be described.

DRAWINGS

FIG. 1A is a isometric side view of an athletic shoe having springs in the heel and ball regions of the foot; FIG. 1B is an isometric view of the spring shown in the ball region; FIG. 1C is an isometric view of the spring shown in the heel region;

FIG. 2 is an isometric side view of an athletic shoe having springs in the ball and heel regions; and FIGS. 3A–3F are diagramatic representations of various other embodiments of springs useful in the invention.

STRUCTURE

Referring to FIG. 1A, an athletic shoe 10 is formed by standard procedure having an upper 12, an outsole 14 and a midsole 16. Also provided is a ball spring 18 in the ball region of the shoe, and a heel spring 20 in the heel region of the shoe.

Referring to FIG. 1B, ball spring 18 is formed generally in the shape of a hairpin with two prongs 19, 21 lying along a plane (not shown). Also provided are two 2 tabs 22, 24 extending from the hairpin generally perpendicularly from this plane. Tabs 22 and 24 are generally planar and adapted for insertion between midsole 16 and either outsole 14 or upper 12. These tabs act to hold spring 18 on the surface of shoe 10. Lower tab 24 may be positioned between midsole 16 and outsole 14 or at any other point in midsole 16 which is at least 3 millimeters below a plane 26 on which the foot of a wearer of shoe 10 lies. If desired, tabs 22 and 24 can be removed and hair spring 18 connected to shoe 10 by adhesive, e.g., glue.

Referring to 1C, heel spring 20 is provided with a tab 26, again formed generally perpendicular to the inner surface of heel spring 20 and adapted for insertion between upper 12 and midsole 16 in the heel region. Lower portion 28 of heel spring 20 is connected to shoe 10 by a generally flat tab 30 which is positioned and held between midsole 16 and outsole 14. Alternatively, tab 30 may be connected to the outer surface of shoe 10 by adhesive. Tab 30 is connected at a location at least 3 millimeters below plane 26, i.e., where the heel of the wearer contacts the midsole.

The above springs are formed of material which absorb energy when bent but return to their original shape, or close to their original shape, after bending. Appropriate materials include plastic such as surlyn, hytrel, nylon, PVC, PU, spring steel, Delrin, or rubber (synthetic or natural). Although the Figures show only one side of a shoe, it is preferred that the springs be provided on both sides of a shoe unless designed to prevent pronation or similar problems. The shoes are formed by any standard procedure, with the spring being connected either by adhesive or by tabs as described above. If tabs are used these may be sewn directly into portions of the shoe, for example between the upper and the midsole or between the midsole and outsole.

Other Embodiments

Other embodiments are within the following claims. For example, referring to FIG. 2, there are shown springs 32 and 34 which are adhesively fixed to a shoe 36 at outsole 38 in ball region 40 and heel region 46. Heel spring 34 is also connected at a location 48 to midsole 41, and ball spring 32 at a location 44 to midsole 41. As can be seen in this embodiment the only requirements of springs useful in this invention are that they are connected at 2 points to the shoe with the lower point being at least 3 millimeters below the plane of the foot of the wearer, and the other point being at least 3 millimeters above that point in the midsole. Between the two points of connection must be an angled piece of material which will bend between the two points when subjected to a vertical force applied to the two points. The remainder of the spring may or may not be fixed to the shoe, and may have any desired design, thus providing aesthetic qualities to the shoe. Such design may extend to the shoe upper.

Referring to FIGS. 4A–4F there are shown seven other embodiments of springs suitable for use in this invention. In FIG. 4A, there is shown a spring 50 in the heel region shaped in the form of a safety pin, and connected between the midsole and upper by a tab (not shown) formed perpendicularly to the inner surface of spring 50. In the ball region is shown a spring 52 fixed by a perpendicular tab (not shown) between the midsole and upper and having a generally boomerang shaped spring attached thereto, and connected to the outsole. Referring to FIGS. 4B, 4C, 4D, 4E, and 4F, there are shown various heel springs formed as V-, U-, Z-, S- and other shapes, respectively.

I claim:

1. An article of footwear comprising:

an upper, an outsole including a first upper surface, a first lower surface and a first external side wall between the perimeters of said first upper and lower surfaces, a midsole provided between said outsole and said upper, said midsole having a second upper surface upon which a sole of a foot is positioned during use of said article of footwear, a second lower surface, and a second external side wall between the perimeters of said second upper and lower surfaces, and an external cushioning spring comprising an angled strip of resilient elastic material, one end of said strip is fixed on said first side wall at location at least 3 mm below said second upper surface of said midsole, and the other end of said strip is fixed on said second sidewall at least 3 mm vertically above said location, such that a vertical force on said footwear created by a wearer of said footwear striking said outsole on a solid surface causes said angled strip to bend between said ends and absorb a portion of said force.

2. An article of footwear comprising:

an upper, an outsole including a first upper surface, a first lower surface and a first external side wall between the perimeters of said first upper and lower surfaces, a midsole provided between said outsole and said upper, said midsole having a second upper surface upon which a sole of a foot is positioned during use of said article of footwear, a second lower surface, and a second external side wall between the perimeters of said second upper and lower surfaces, and an external cushioning spring comprising an angled strip of resilient elastic material, one end of said strip is fixed on said second side wall at a location at least 3 mm below said second upper surface of said midsole, and the other end of said strip is fixed on said second sidewall at least 3 mm vertically above said location, such that a vertical force on said footwear created by a wearer of said footwear striking said outsole on a solid surface causes said angled strip to bend between said ends and absorb a portion of said force.

3. The article of footwear of claim 1 or 2, wherein one end of said spring is fixed to said footwear at a junction between said midsole and said upper.

4. The article of footwear of claim 1 or 2, wherein said spring comprises an extension formed generally perpendicular to said angled strip adapted for insertion between said outsole and said midsole, and between said midsole and said upper.

5. The article of footwear of claim 4, wherein said extension is fixedly connected to said angled strip.

6. The article of footwear of claim 5, wherein said angled strip is in the form of U shape.

7. The article of footwear of claim 4, wherein said angled strip is in the form of a hairpin shape.

8. The article of footwear of claim 7, wherein said angled strip is fixed to said footwear at a heel portion.

9. The article of footwear of claim 8, wherein said spring comprises a heel cup attached to said angled strip.

10. The article of footwear of claim 9, wherein said spring is attached by adhesive to said heel cup.

11. The article of footwear of claim 10, wherein both said ends are attached to said midsole.

12. The article of footwear of claim 11, comprising a plurality of said springs.

13. The article of footwear of claim 12, wherein said angled strip is applied along its length to said second side wall of said midsole.

14. The article of footwear of claim 13, comprising an angled strip attached in the ball region of said footwear.

15. A method of making an article of footwear comprising the steps of:

(a) providing an upper, (b) providing an outsole including a first upper surface, a first lower surface and a first external side wall between the perimeters of said first upper and lower surfaces, (c) providing a midsole having a second upper surface upon which a sole of a foot is positioned during use, a second lower surface, and a second external side wall between the perimeters of said second upper and lower surfaces, (d) providing an external cushioning spring including an angled strip of resilient elastic material, (e) fixing said midsole between said upper and said outsole, (f) fixing one end of the external cushioning spring on said second side wall of said midsole at a location at least 3 millimeters below said second upper surface of said midsole, and (g) fixing the other end of said angled strip on said second side wall of said midsole at least 3 millimeters vertically above said location at which said one end is fixed, such that a vertical force on said footwear created by a wearer of said footwear striking said outsole on a solid surface causes said angled strip to bend between said ends and absorb a portion of said force.

16. A method of making an article of footwear comprising the steps of:

(a) providing an upper, (b) providing an outsole including a first upper surface, a first lower surface and a first external side wall between the perimeters of said first upper and lower surfaces, (c) providing a midsole having a second upper surface upon which a sole of a foot is positioned during use, a second lower surface, and a second external side wall between the perimeters of said second upper and lower surfaces, (d) providing an external cushioning spring including an angled strip of resilient elastic material, (e) fixing said midsole between said upper and said outsole, (f) fixing one end of the external cushioning spring on said first side wall of said outsole at a location at least 3 millimeters below said second upper surface of said midsole, and (g) fixing the other end of said angled strip on said second side wall of said midsole at least 3 millimeters vertically above said location at which said one end is fixed, such that a vertical force on said footwear created by a wearer of said footwear striking said outsole on a solid surface causes said angled strip to bend between said ends and absorb a portion of said force.

17. The method of claim 16 or 15, wherein said spring comprises an extension, formed generally perpendicular to said angled strip, adapted for insertion between said outsole and said midsole, and between said midsole and said upper, and one said fixing step comprises inserting said extension between said outsole and said midsole.

18. The method of claim 16 or 15, wherein said fixing is by gluing.

19. The article of footwear of claim 1 or 2, wherein one end of said spring is fixed to said footwear at a junction between said outsole and said midsole.

20. The article of footwear of claim 5, wherein said angled strip is in the form of V shape.

21. The article of footwear of claim 5, wherein said angled strip is in the form of Z shape.

22. The method of claim 16 or 15, wherein said spring comprises an extension, formed generally perpendicular to said angled strip, adapted for insertion between said outsole and said midsole, and between said midsole and said upper, and one said fixing step comprises inserting said extension between said midsole and said upper.

* * * * *

UNITED STATES PATENT AND TRADEMARK OFFICE

CERTIFICATE OF CORRECTION

PATENT NO. : 5,060,401 C1
DATED : October 7, 2003
INVENTOR(S) : Whatley

It is certified that error appears in the above-identified patent and that said Letters Patent is hereby corrected as shown below:

Column 2,
Lines 16 and 19, change “23” to -- 24 --

Column 3,
Line 6, change the claim number “24” to -- 25 --

Signed and Sealed this

Twenty-seventh Day of July, 2004

JON W. DUDAS
*Acting Director of the United States Patent and Trademark Office*

US005060401C1

(12) EX PARTE REEXAMINATION CERTIFICATE (4858th)

United States Patent

Whatley

(10) Number: US 5,060,401 C1

(45) Certificate Issued: Oct. 7, 2003

(54) FOOTWEAR CUSHIONING SPRING

(75) Inventor: Ian H. Whatley, 926 Cleveland St., Apt. F-101, Greenville, SC (US) 29601

(73) Assignee: Ian H. Whatley, Greenville, SC (US)

Reexamination Request:
No. 90/005,556, Nov. 10, 1999

Reexamination Certificate for:

| | |
|---|---|
| Patent No.: | **5,060,401** |
| Issued: | **Oct. 29, 1991** |
| Appl. No.: | **07/478,369** |
| Filed: | **Feb. 12, 1990** |

(51) Int. Cl.[7] ..... A43B 13/00

(52) U.S. Cl. ..... 36/25 R; 36/28; 36/71; 36/114; 36/7.8; 36/27

(58) Field of Search ..... 36/27, 28, 29, 36/35 R, 35 B, 71, 114, 7.8

(56) References Cited

U.S. PATENT DOCUMENTS

| | | | | |
|---|---|---|---|---|
| 4,194,310 A | | 3/1980 | Bowerman | 36/128 |
| 4,297,796 A | | 11/1981 | Stirtz et al. | 36/28 |
| 4,314,413 A | | 2/1982 | Dassler | 36/129 |
| 4,316,334 A | | 2/1982 | Hunt | 36/91 |
| 4,342,158 A | | 8/1982 | McMahon et al. | 36/35 R |
| 4,399,621 A | | 8/1983 | Dassler | 36/32 R |
| 4,402,146 A | | 9/1983 | Parracho et al. | 36/129 |
| 4,459,765 A | | 7/1984 | Power | 36/88 |
| 4,484,397 A | | 11/1984 | Curley, Jr. | 36/92 |
| 4,598,487 A | | 7/1986 | Misevich | 36/114 |
| 4,638,577 A | | 1/1987 | Riggs | 36/114 |
| 4,641,438 A | | 2/1987 | Laird et al. | 36/59 |
| 4,697,362 A | | 10/1987 | Wasserman | 36/136 |
| 4,712,319 A | | 12/1987 | Goria | 36/137 |
| 4,798,010 A | | 1/1989 | Sugiyama | 36/30 R |
| 4,854,055 A | | 8/1989 | Sugiyama et al. | 37/128 |
| 4,866,861 A | | 9/1989 | Noone | 36/127 |
| 4,947,560 A | | 8/1990 | Fuerst et al. | 36/88 |
| 4,949,476 A | | 8/1990 | Anderie | 36/129 |
| 5,005,300 A | * | 4/1991 | Diaz et al. | |
| 5,014,449 A | | 5/1991 | Richard et al. | 36/114 |
| 5,046,267 A | | 9/1991 | Kilgore et al. | 36/114 |
| 5,052,130 A | | 10/1991 | Barry et al. | 36/107 |
| 5,224,277 A | | 7/1993 | Sang Do | 36/27 |
| 5,247,742 A | | 9/1993 | Kilgore et al. | 36/114 |
| 5,297,349 A | | 3/1994 | Kilgore | 36/114 |
| 5,353,526 A | | 10/1994 | Foley et al. | 36/92 |

FOREIGN PATENT DOCUMENTS

| | | |
|---|---|---|
| DE | 28 45 171 | 10/1978 |
| DE | 2706645 | 4/1979 |
| DE | 29 33 393 | 8/1979 |
| DE | 3329742 | 7/1984 |
| EP | 0258718 | 8/1987 |
| GB | 2 032 761 | 5/1980 |

(List continued on next page.)

OTHER PUBLICATIONS

Exhibit A to Nike of Japan Patent Publication 55–94201.*
Exhibit A to Nike of Japanese Utility Model 59–103605, German Patent DE 33 29 742.*

(List continued on next page.)

*Primary Examiner*—Ted Kavanaugh

(57) ABSTRACT

An article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The term "midsole" is meant to include any cushioning or other device placed within the footwear upon which a foot is positioned during use of the article. The midsole is also provided with an external cushioning spring. This spring includes an angled strip of resilient elastic material. One end of the strip is fixed on the surface of the midsole or outsole at a location at least 3 mm below the upper surface of the midsole. The other end of the strip is fixed on the surface of the midsole at least 3 mm vertically above the location at which the one end is fixed. The external cushioning spring is fixed in a manner such that a vertical force on the footwear created by a wearer of the footwear striking the outsole on a solid surface causes the angled strip to bend between its ends thereby absorbing a portion of the force.

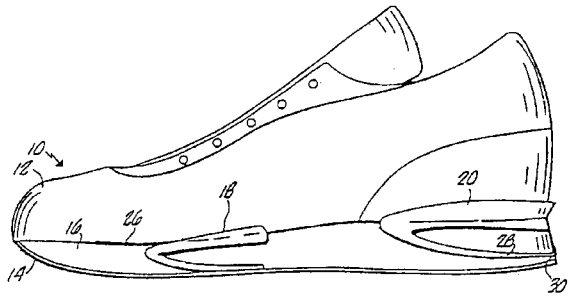

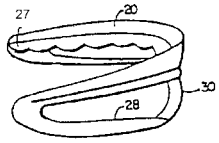

(Amended)

FOREIGN PATENT DOCUMENTS

| | | |
|---|---|---|
| JP | 632224 | 8/1984 |
| JP | 635926 | 10/1984 |
| JP | 62-200904 | 12/1987 |
| JP | 3085103 | 4/1991 |
| TW | 109600 | 3/1989 |
| TW | 125849 | 12/1989 |
| TW | 157875 | 1/1990 |
| TW | 128167 | 2/1990 |
| TW | 12140696 | 8/1990 |

OTHER PUBLICATIONS

Exhibit A to Nike of Japanese Utility Model Publication 61–37303.*

Exhibit A to Nike of Taiwanese Patent No. 146576, Appl. No. 79303878.*

Exhibit A to Nike of Taiwanese Patent Document No. 77238.*

*Reebok Product Preview for Fall 1990* catalog dated 1989–1990.

* cited by examiner

Figure 1A:
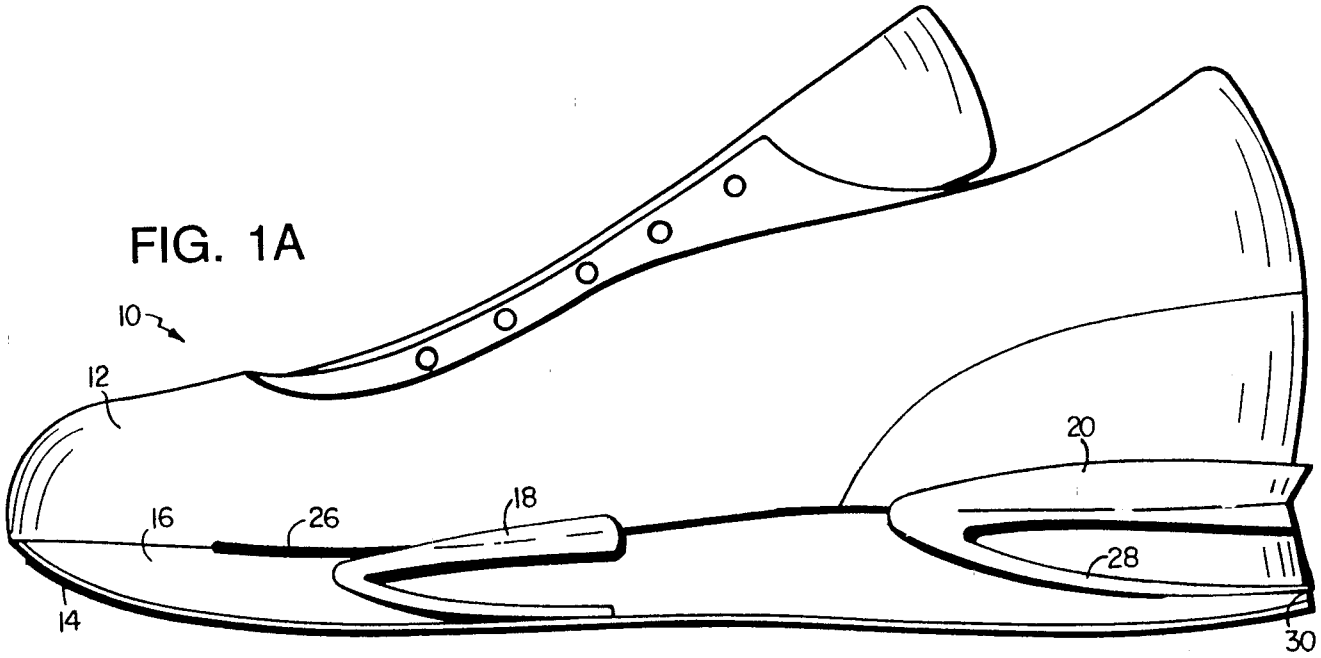
Figure 1B:
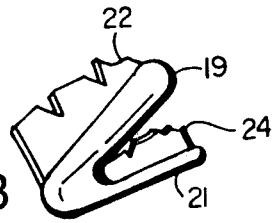
Figure 1C:
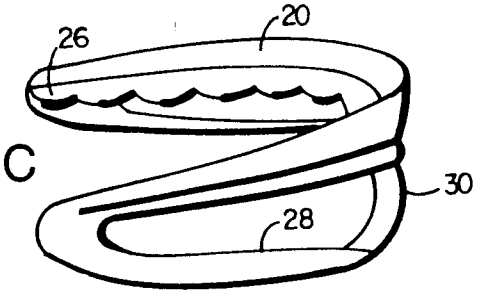
Figure 2:
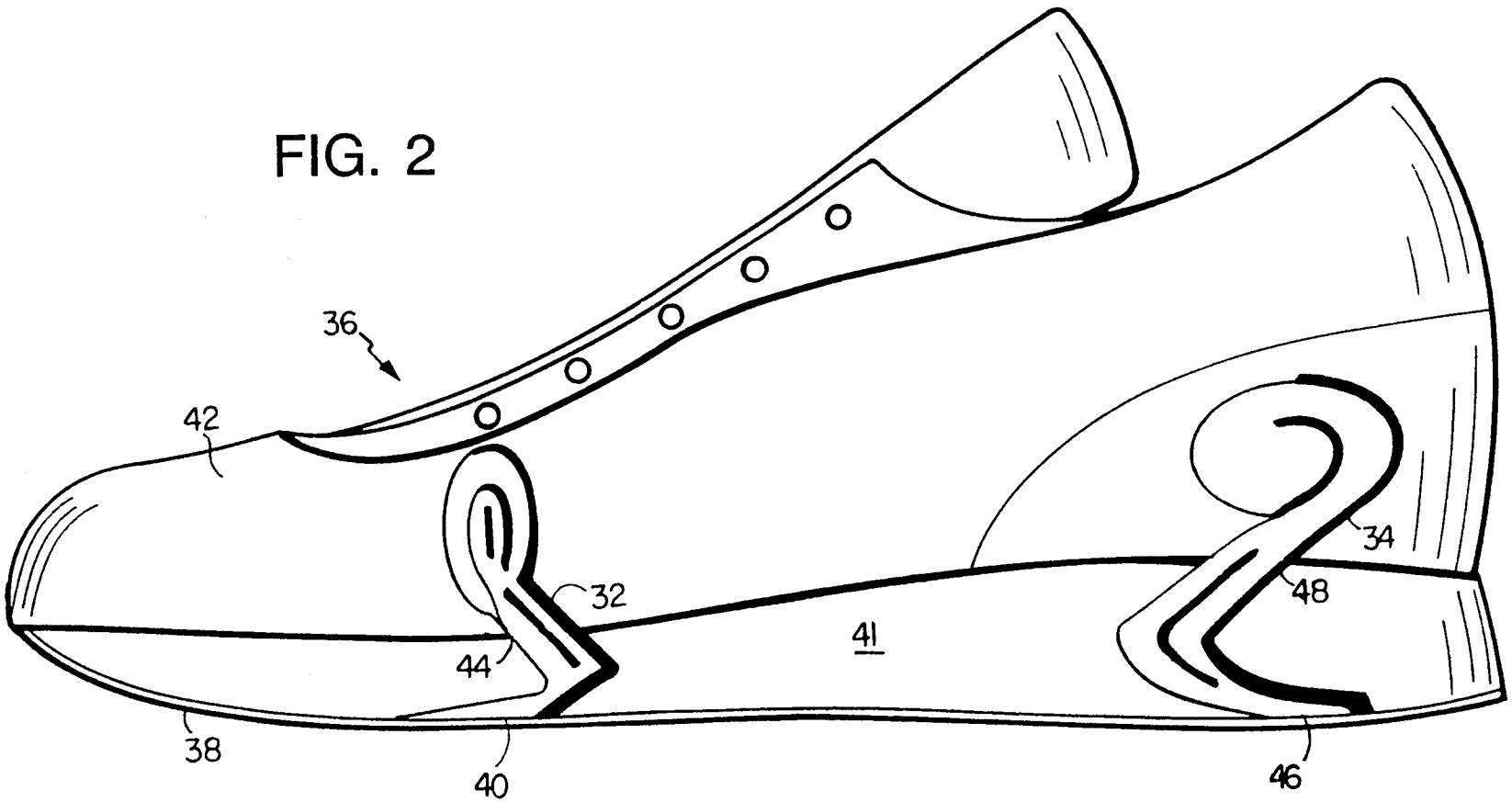
Figure 3A:
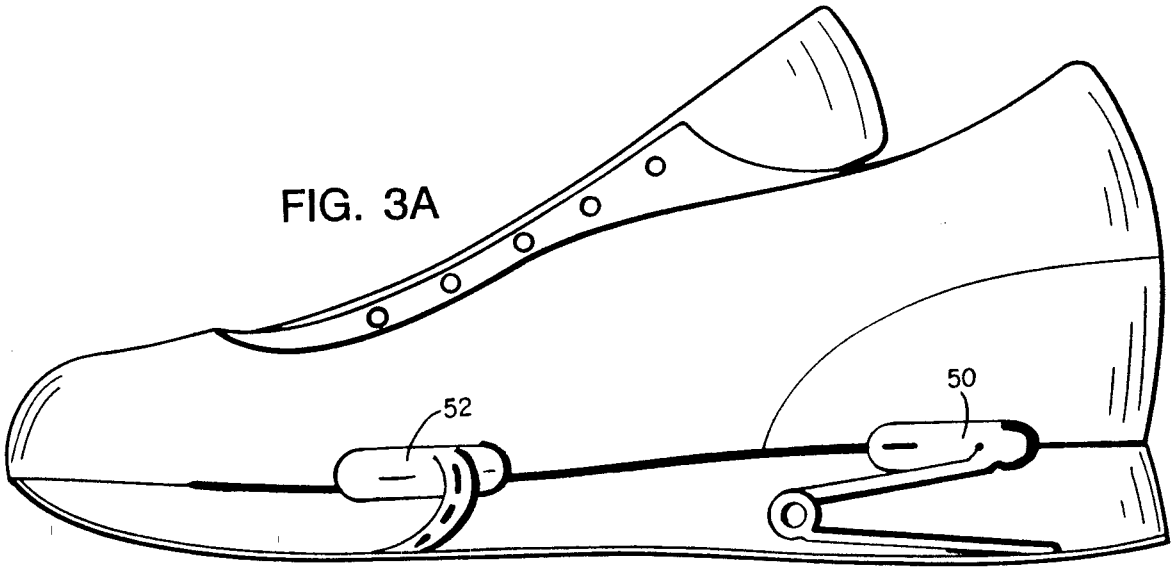
Figure 3B:
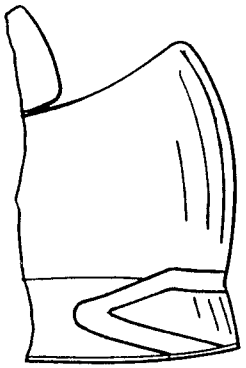
Figure 3C:
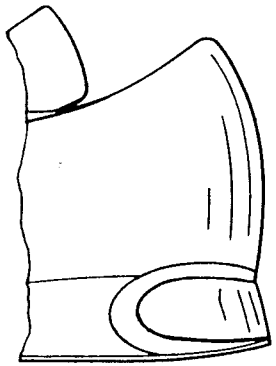
Figure 3D:
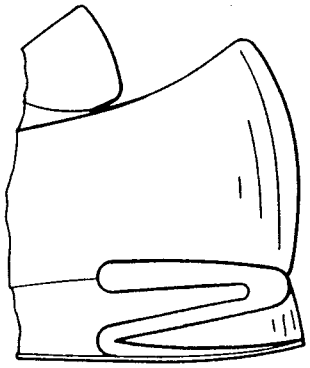
Figure 3E:
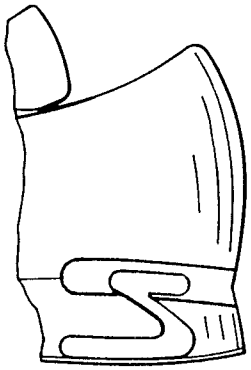
Figure 3F:
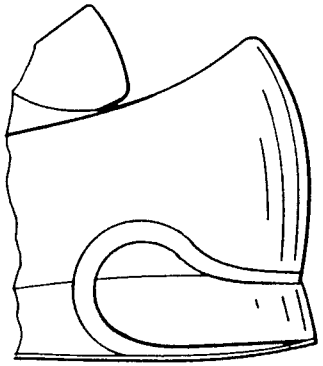
Figure 1A:
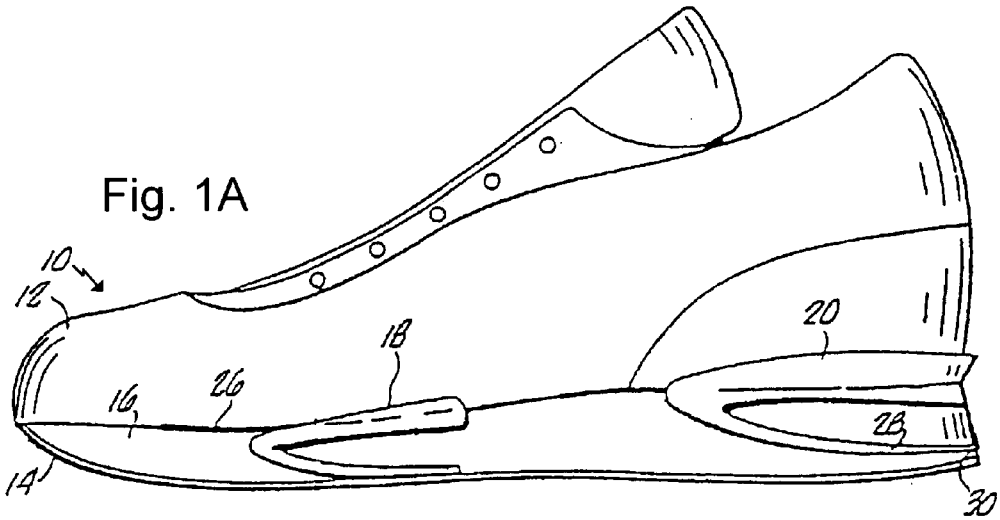
Figure 1B:
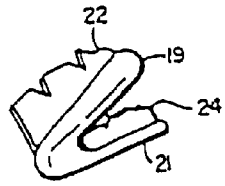

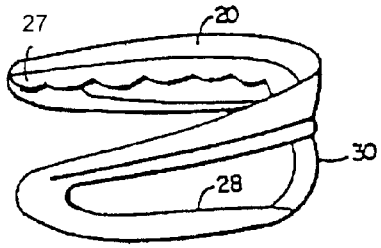
Fig. 1C
(Amended)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

THE DRAWING FIGURES HAVE BEEN CHANGED AS FOLLOWS:

In FIG. 1C reference numeral 26 has been changed to 27.

ONLY THOSE PARAGRAPHS OF THE SPECIFICATION AFFECTED BY AMENDMENT ARE PRINTED HEREIN.

Column 3, lines 46–59:

Referring to FIG. 1B, ball spring 18 is formed generally in the shape of a hairpin with two prongs 19, 21 lying along a plane (not shown). Also provided are two [2] tabs 22, 24 extending from the hairpin generally perpendicularly from this plane. Tabs 22 and 24 are generally planar and adapted for insertion between midsole 16 and either outsole 14 or upper 12. These tabs act to hold spring 18 on the surface of shoe 10. Lower tab 24 may be positioned between midsole 16 and outsole 14 or at any other point in midsole 16 which is at least 3 millimeters below a plane 26 on which the foot of a wearer of shoe 10 lies. If desired, tabs 22 and 24 can be removed and hair spring 18 connected to shoe 10 by adhesive, e.g., glue.

Column 3, line 60–column 4, line 2:

Referring to 1C, heel spring 20 is provided with a tab [26] *27*, again formed generally perpendicular to the inner surface of heel spring 20 and adapted for insertion between upper 12 and midsole 16 in the heel region. Lower portion 28 of heel spring 20 is connected to shoe 10 by a generally flat tap 30 which is positioned and held between midsole 16 and outsole 14. Alternatively, tab 30 may be connected to the outer surface of shoe 10 by adhesive. Tab 30 is connected at a location at least 3 millimeters below plane 26, i.e., where the heel of the wearer contacts the midsole.

Column 4, lines 39–51:

Referring to FIGS. [4A–4F] *3A–3F* there are shown seven other embodiments of springs suitable for use in this invention. In FIG. [4A] *3A*, there is shown a spring 50 in the heel region shaped in the form of a safety pin, and connected between the midsole and upper by a tab (not shown) formed perpendicularly to the inner surface of spring 50. In the ball region is shown a spring 52 fixed by a perpendicular tab (not shown) between the midsole and upper and having a generally boomerang shaped spring attached thereto, and connected to the outsole. Referring to FIGS. [4B, 4C,4D, 4E, and 4F] *3B, 3C, 3D, 3E, and 3F*, there are shown various heel springs formed as V-,U-,Z-,S- and other shapes, respectively.

AS A RESULT OF REEXAMINATON, IT HAS BEEN DETERMINED THAT:

The patentability of claims 1 and 16 is confirmed.

Claims 2, 3 and 15 are cancelled.

Claims 4, 5, 7, 17–19 and 22 are determined to be patentable as amended.

Claims 6, 8–14, 20 and 21, dependent on an amended claim, are determined to be patentable.

New claims 23–26 are added and determined to be patentable.

4. The article of footwear of claim 1 [or 2], wherein said spring comprises an extension formed generally perpendicular to said angled strip adapted for insertion between said outsole and said midsole, and between said midsole and said upper.

5. The article of footwear of claim 4 *or 23*, wherein said extension is fixedly connected to said angled strip.

7. The article of footwear of claim 4 *or 23*, wherein said angled strip is in the form of a hairpin shape.

17. The method of claim 16 [or 15], wherein said spring comprises an extension, formed generally perpendicular to said angled strip, adapted for insertion between said outsole and said midsole, and between said midsole and said upper, and one said fixing step comprises inserting said extension between said outsole and said midsole.

18. The method of claim 16 [or 15], wherein said fixing is by gluing.

19. The article of footwear of claim 1 [or 2], wherein one end of said spring is fixed to said footwear at a junction between said outsole and said midsole.

22. The method of claim 16 [or 15], wherein said spring comprises an extension, formed generally perpendicular to said angled strip, adapted for insertion between said outsole and said midsole, and between said midsole and said upper, and one said fixing step comprises inserting said extension between said midsole and said upper.

*23. The article of footwear of claim 1 wherein one end of said spring is fixed to said footwear at a junction between said midsole and said upper.*

*24. An article of footwear comprising:*

*an upper,*

*an outsole including a first upper surface, a first lower surface and a first external side wall between the perimeters of said first upper and lower surfaces,*

*a midsole provided between said outsole and said upper,*

*said midsole having a second upper surface upon which a sole of a foot is positioned during use of said article of footwear, a second lower surface, and a second external side wall between the perimeters of said second upper and lower surfaces, and*

*an external cushioning spring comprising an angled strip of resilient elastic material, one end of said strip is fixed on said second side wall at a location at least 3 mm below said second upper surface of said midsole, and the other end of said strip is fixed on said second sidewall at least 3 mm vertically above said location, such that a vertical force on said footwear created by a wearer of said footwear striking said outsole on a solid surface causes said angled strip to bend between*

*said ends and absorb a portion of said force, wherein said spring comprises an extension formed generally perpendicular to said angled strip adapted for insertion between said outsole and said midsole, and between said midsole and said upper.*

*24. A method of making an article of footwear comprising the steps of:*

(*a*) *providing an upper,*

(*b*) *providing an outsole including a first upper surface, a first lower surface and a first external side wall between the perimeters of said first upper and lower surfaces,*

(*c*) *providing a midsole having a second upper surface upon which a sole of a foot is positioned during use, a second lower surface, and a second external side wall between the perimeters of said second upper and lower surfaces,*

(*d*) *providing an external cushioning spring including an angled strip of resilient elastic material,*

(*e*) *fixing said midsole between said upper and said outsole,*

(*f*) *fixing one end of the external cushioning spring on said second side wall of said midsole at a location at least 3 millimeters below said second upper surface of said midsole, and*

(*g*) *fixing the other end of said angled strip on said second side wall of said midsole at least 3 millimeters vertically above said location at which said one end is fixed, such that a vertical force on said footwear created by a wearer of said footwear striking said outsole on a solid surface causes said angled strip to bend between said ends and absorb a portion of said force, wherein said spring comprises an extension, formed generally perpendicular to said angled strip, adapted for insertion between said outsole and said midsole, and between said midsole and said upper, and one said fixing step comprises inserting said extension between said outsole and said midsole.*

*26. A method of making an article of footwear comprising the steps of:*

(*a*) *providing an upper,*

(*b*) *providing an outsole including a first upper surface, a first lower surface and a first external side wall between the perimeters of sad first upper and lower surfaces,*

(*c*) *providing a midsole having a second upper surface upon which a sole of a foot is positioned during use, a second lower surface, and a second external side wall between the perimeters of said second upper and lower surfaces,*

(*d*) *providing an external cushioning spring including an angled strip of resilient elastic material,*

(*e*) *fixing said midsole between said upper and said outsole,*

(*f*) *fixing one end of the external cushioning spring on said second side wall of said midsole at a location at least 3 millimeters below said second upper surface of said midsole, and*

(*g*) *fixing the other end of said angled strip on said second side wall of said midsole at least 3 millimeters vertically above said location at which said one end is fixed, such that a vertical force on said footwear created by a wearer of said footwear striking said outsole on a solid surface causes said angled strip to bend between said ends and absorb a portion of said force, wherein said spring comprises an extension, formed generally perpendicular to said angled strip, adapted for insertion between said outsole and said midsole, and between said midsole and said upper, and one said fixing step comprises inserting said extension between said midsole and said upper.*

* * * * *

US005060401C2

(12) EX PARTE REEXAMINATION CERTIFICATE (7710th)

United States Patent

Whatley

(10) Number: US 5,060,401 C2

(45) Certificate Issued: Aug. 31, 2010

(54) FOOTWEAR CUSHIONING SPRING

(75) Inventor: Ian H. Whatley, Greenville, SC (US)

(73) Assignee: Cushion Technologies, LLC, Richardson, TX (US)

Reexamination Request:
No. 90/008,876, Oct. 10, 2007

Reexamination Certificate for:

| | |
|---|---|
| Patent No.: | **5,060,401** |
| Issued: | **Oct. 29, 1991** |
| Appl. No.: | **07/478,369** |
| Filed: | **Feb. 12, 1990** |

Reexamination Certificate C1 5,060,401 issued Oct. 7, 2003

Certificate of Correction issued Jul. 27, 2004.

(51) Int. Cl.
*A43B 13/00* (2006.01)

(52) U.S. Cl. ..... 36/25 R; 36/7.8; 36/27; 36/28; 36/71; 36/114

(58) Field of Classification Search ..... 36/25 R, 36/27, 71, 114, 7.8
See application file for complete search history.

(56) References Cited

U.S. PATENT DOCUMENTS

| | | | |
|---|---|---|---|
| 87,722 | A | 3/1869 | Stewart |
| 224,937 | A | 2/1880 | Mintzer |
| 226,792 | A | 4/1880 | Robinson |
| 323,971 | A | 8/1885 | Swan |
| 354,986 | A | 12/1886 | Martin |
| 532,429 | A | 1/1895 | Rogers |
| 729,761 | A | 6/1903 | Harland |
| 861,947 | A | 7/1907 | Brennan |
| 898,951 | A | 9/1908 | Zooboavch |
| 959,956 | A | 5/1910 | Moorefield |
| 1,188,717 | A | 6/1916 | Bennett |
| 1,347,061 | A | 7/1920 | Steinbrecher |
| 1,470,592 | A | 10/1923 | Berthet |
| 1,767,801 | A | 6/1930 | Laible |
| 1,830,091 | A | 11/1931 | Cox |

(Continued)

FOREIGN PATENT DOCUMENTS

| | | |
|---|---|---|
| DE | 1670403 | 1/1954 |
| DE | 2424889 | 12/1975 |
| DE | 7729025 | 1/1978 |
| DE | 2654116 A1 | 6/1978 |
| DE | 2706645 A1 | 8/1978 |
| DE | 2933393 A1 | 2/1981 |
| DE | 3034126 A1 | 3/1982 |
| DE | 3317462 A1 | 10/1983 |
| DE | 3320502 A1 | 12/1983 |
| DE | 3430845 A1 | 7/1985 |

(Continued)

*Primary Examiner*—Matthew C. Graham

(57) ABSTRACT

An article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The term "midsole" is meant to include any cushioning or other device placed within the footwear upon which a foot is positioned during use of the article. The midsole is also provided with an external cushioning spring. This spring includes an angled strip of resilient elastic material. One end of the strip is fixed on the surface of the midsole or outsole at a location at least 3 mm below the upper surface of the midsole. The other end of the strip is fixed on the surface of the midsole at least 3 mm vertically above the location at which the one end is fixed. The external cushioning spring is fixed in a manner such that a vertical force on the footwear created by a wearer of the footwear striking the outsole on a solid surface causes the angled strip to bend between its ends thereby absorbing a portion of the force.

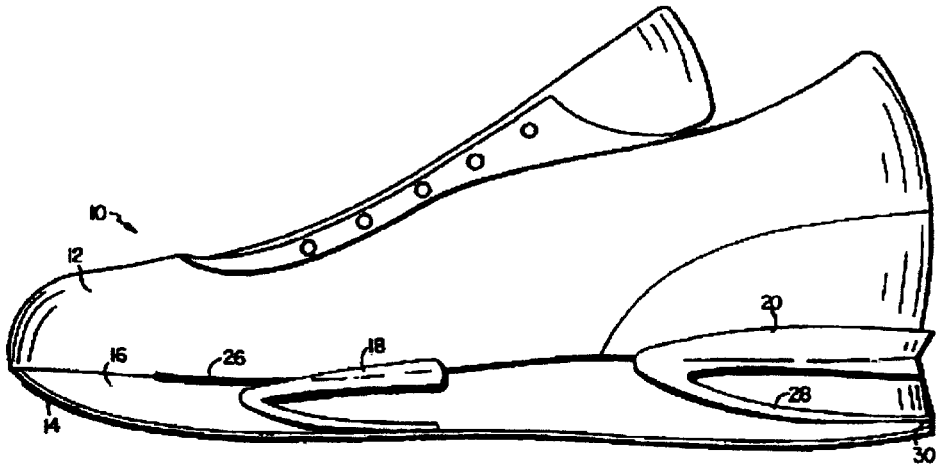

U.S. PATENT DOCUMENTS

| | | | |
|---|---|---|---|
| 2,123,288 | A | 7/1938 | Noyes |
| 2,275,720 | A | 3/1942 | Bingham, Jr. |
| 2,399,543 | A | 4/1946 | Dack |
| 2,444,865 | A | 7/1948 | Warrington |
| 2,508,318 | A | 5/1950 | Wallach |
| 2,555,654 | A | 6/1951 | Ostrom |
| 2,804,700 | A | 9/1957 | Holtkamp et al. |
| 2,953,861 | A | 9/1960 | Horten |
| 3,028,689 | A | 4/1962 | Dassler |
| 3,029,530 | A | 4/1962 | Eaton |
| 3,777,374 | A | 12/1973 | Hendricks |
| 3,822,488 | A | 7/1974 | Johnson |
| 3,834,046 | A | 9/1974 | Fowler |
| 3,886,674 | A | 6/1975 | Pavia |
| 4,030,213 | A | 6/1977 | Daswick |
| 4,102,061 | A | 7/1978 | Saaristo |
| 4,128,950 | A | 12/1978 | Bowerman et al. |
| 4,194,310 | A | 3/1980 | Bowerman |
| D256,067 | S | 7/1980 | Hagg et al. |
| 4,235,026 | A | 11/1980 | Plagenhoef |
| 4,297,796 | A | 11/1981 | Stirtz et al. |
| 4,314,413 | A | 2/1982 | Dassler |
| 4,316,334 | A | 2/1982 | Hunt |
| 4,342,158 | A | 8/1982 | McMahon et al. |
| 4,372,058 | A | 2/1983 | Stubblefield |
| 4,399,621 | A | 8/1983 | Dassler |
| 4,402,146 | A | 9/1983 | Parracho et al. |
| 4,435,910 | A | 3/1984 | Marc |
| 4,449,306 | A | 5/1984 | Cavanagh |
| 4,449,307 | A | 5/1984 | Stubblefield |
| 4,451,994 | A | 6/1984 | Fowler |
| 4,484,397 | A | 11/1984 | Curley, Jr. |
| 4,492,046 | A | 1/1985 | Kosova |
| 4,506,460 | A | 3/1985 | Rudy |
| 4,536,974 | A | 8/1985 | Cohen |
| 4,542,598 | A | 9/1985 | Misevich et al. |
| 4,546,555 | A | 10/1985 | Spademan |
| 4,546,559 | A | 10/1985 | Dassler |
| 4,561,195 | A | 12/1985 | Onoda et al. |
| 4,566,206 | A | 1/1986 | Weber |
| 4,573,279 | A | 3/1986 | Feurer-Zogel et al. |
| 4,592,153 | A | 6/1986 | Jacinto |
| 4,598,487 | A | 7/1986 | Misevich |
| 4,611,412 | A | 9/1986 | Cohen |
| 4,614,046 | A | 9/1986 | Dassler |
| 4,638,577 | A | 1/1987 | Riggs |
| 4,641,438 | A | 2/1987 | Laird et al. |
| 4,676,011 | A | 6/1987 | O'Rourke et al. |
| D291,146 | S | 8/1987 | Selbiger |
| 4,697,362 | A | 10/1987 | Wasserman |
| 4,712,319 | A | 12/1987 | Goria |
| 4,731,939 | A | 3/1988 | Parracho et al. |
| D296,150 | S | 6/1988 | Diaz |
| 4,753,021 | A | 6/1988 | Cohen |
| 4,754,559 | A | 7/1988 | Cohen |
| 4,757,620 | A | 7/1988 | Tiitola |
| D296,952 | S | 8/1988 | Brown et al. |
| 4,766,679 | A | 8/1988 | Bender |
| 4,771,554 | A | 9/1988 | Hannemann |
| 4,776,111 | A | 10/1988 | Crowley |
| 4,790,083 | A | 12/1988 | Dufour |
| 4,798,010 | A | 1/1989 | Sugiyama |
| D299,785 | S | 2/1989 | Diaz |
| 4,854,055 | A | 8/1989 | Sugiyama et al. |
| 4,866,861 | A | 9/1989 | Noone |
| 4,876,806 | A | 10/1989 | Robinson et al. |
| 4,878,301 | A | 11/1989 | Kiyosawa |
| 4,881,329 | A | 11/1989 | Crowley |
| 4,910,884 | A | 3/1990 | Lindh et al. |
| 4,922,631 | A | 5/1990 | Anderié |
| 4,924,605 | A | 5/1990 | Spademan |
| 4,942,677 | A | 7/1990 | Flemming et al. |
| 4,944,099 | A | 7/1990 | Davis |
| 4,947,560 | A | 8/1990 | Fuerst et al. |
| 4,949,476 | A | 8/1990 | Anderie |
| 4,972,611 | A | 11/1990 | Swartz et al. |
| 4,989,350 | A | 2/1991 | Bunch et al. |
| D315,633 | S | 3/1991 | Nakao |
| 5,005,299 | A | 4/1991 | Whatley |
| 5,014,449 | A | 5/1991 | Richard et al. |
| D319,718 | S | 9/1991 | Del Vecchio, Jr. et al. |
| 5,046,264 | A | 9/1991 | Hultzsch et al. |
| 5,046,267 | A | 9/1991 | Kilgore et al. |
| 5,060,401 | A | 10/1991 | Whatley |
| 5,070,629 | A | 12/1991 | Graham et al. |
| 5,090,138 | A | 2/1992 | Borden |
| D325,288 | S | 4/1992 | Richard et al. |
| 5,131,173 | A | 7/1992 | Anderie |
| 5,138,776 | A | 8/1992 | Levin |
| 5,155,297 | A | 10/1992 | Lindstadt et al. |
| 5,185,943 | A | 2/1993 | Tong et al. |
| 5,187,883 | A | 2/1993 | Penney |
| 5,224,277 | A | 7/1993 | Sang Do |
| 5,247,742 | A | 9/1993 | Kilgore et al. |
| 5,255,451 | A | 10/1993 | Tong et al. |
| 5,297,349 | A | 3/1994 | Kilgore |
| 5,311,678 | A | 5/1994 | Spademan |
| 5,319,866 | A | 6/1994 | Foley et al. |
| 5,319,869 | A | 6/1994 | McDonald et al. |
| 5,337,492 | A | 8/1994 | Anderie et al. |
| 5,343,639 | A | 9/1994 | Kilgore et al. |
| 5,353,526 | A | 10/1994 | Foley et al. |
| 5,595,003 | A | 1/1997 | Snow |
| 5,896,608 | A | 4/1999 | Whatley |

FOREIGN PATENT DOCUMENTS

| | | | |
|---|---|---|---|
| DE | 8504763 | | 7/1985 |
| DE | 8508599 | | 8/1985 |
| DE | 3415705 | A1 | 10/1985 |
| DE | 3542960 | A1 | 6/1986 |
| DE | 8626233 | | 1/1987 |
| DE | 3538601 | A1 | 5/1987 |
| DE | 8225659 | | 6/1987 |
| DE | 3629340 | A1 | 3/1988 |
| DE | 8905050 | | 9/1989 |
| EP | 0096542 | | 12/1983 |
| EP | 0103041 | | 3/1984 |
| EP | 0258718 | | 3/1988 |
| EP | 0359421 | | 3/1990 |
| FR | 1010410 | | 6/1952 |
| FR | 2438983 | | 5/1980 |
| FR | 2507066 | | 12/1982 |
| FR | 2650488 | A1 | 2/1991 |
| GB | 1082382 | | 9/1967 |
| GB | 1214059 | | 12/1970 |
| GB | 2000676 | A | 1/1979 |
| GB | 1540926 | A | 2/1979 |
| GB | 2 032 761 | A | 5/1980 |
| GB | 2243530 | A | 6/1991 |
| JP | 62-200904 | | 12/1967 |
| JP | 48-57741 | | 8/1973 |
| JP | 48057741 | | 8/1973 |
| JP | 50-116559 | | 9/1975 |
| JP | 50116559 | | 9/1975 |
| JP | 61-37303 | | 10/1986 |
| JP | 63-200703 | | 8/1988 |
| JP | 1-126903 | | 5/1989 |
| JP | 1-230302 | | 9/1989 |
| JP | 03-85103 | | 4/1991 |

| | | |
|---|---|---|
| TW | 00157875 | 5/1991 |
| WO | WO08808263 A1 | 11/1988 |
| WO | WO-8911047 A1 | 11/1989 |
| WO | WO-9111926 A1 | 8/1991 |

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 6-14 and 21 is confirmed.
Claims 2, 3 and 15 were previously cancelled.
Claims 1, 4, 5, 16-20 and 22-26 are cancelled.

* * * * *